US010577204B2

(12) United States Patent
Yazawa

(10) Patent No.: US 10,577,204 B2
(45) Date of Patent: Mar. 3, 2020

(54) STACKING APPARATUS, FEEDING APPARATUS, AND IMAGE FORMING APPARATUS

(71) Applicant: CANON FINETECH NISCA INC., Misato-shi (JP)

(72) Inventor: Hiroshi Yazawa, Kai (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/110,307

(22) Filed: Aug. 23, 2018

(65) Prior Publication Data

US 2019/0062081 A1 Feb. 28, 2019

(30) Foreign Application Priority Data

Aug. 31, 2017 (JP) ..... 2017-167641
Aug. 9, 2018 (JP) ..... 2018-150627

(51) Int. Cl.

| | |
|---|---|
| ***B65H 1/28*** | (2006.01) |
| ***B65H 1/26*** | (2006.01) |
| ***B65H 1/04*** | (2006.01) |
| ***B65H 7/20*** | (2006.01) |
| ***B65H 7/02*** | (2006.01) |

(52) U.S. Cl.

CPC ..... *B65H 1/28* (2013.01); *B65H 1/04* (2013.01); *B65H 1/266* (2013.01); *B65H 7/02* (2013.01); *B65H 7/20* (2013.01); *B65H 2405/1122* (2013.01); *B65H 2405/11161* (2013.01); *B65H 2405/15* (2013.01); *B65H 2511/10* (2013.01); *B65H 2511/20* (2013.01); *B65H 2511/414* (2013.01); *B65H 2701/528* (2013.01)

(58) Field of Classification Search

CPC .. B65H 1/28; B65H 39/043; B65H 2701/528; B65H 2405/331; B65H 2405/3311

See application file for complete search history.

(56) References Cited

U.S. PATENT DOCUMENTS

| | | | | |
|---|---|---|---|---|
| 6,123,329 | A * | 9/2000 | Sato | B65H 1/14 271/145 |
| 8,267,395 | B2 * | 9/2012 | Yang | B41J 13/103 271/157 |
| 8,585,037 | B1 * | 11/2013 | Jacobs | B65H 1/28 271/157 |
| 2006/0175746 | A1 * | 8/2006 | Adachi | B65H 3/48 271/97 |
| 2016/0257507 | A1 * | 9/2016 | Nakagawa | B65H 1/08 |
| 2018/0354738 | A1 | 12/2018 | Yazawa | |

FOREIGN PATENT DOCUMENTS

JP 2003-063719 A 3/2003

* cited by examiner

*Primary Examiner* — Howard J Sanders
(74) *Attorney, Agent, or Firm* — Venable LLP

(57) ABSTRACT

A stacking apparatus includes a limiting member which moves along a feeding direction and limits a trailing edge of a stacked sheet in the feeding direction, and a partition member which partitions a space at a height which is lower than a predetermined height, into a first space corresponding to a first stacking unit and a second space corresponding to a second stacking unit in a feeding direction. The partition member includes a first opening portion for communicating the first space and the second space with each other, and a second opening portion that allows the limiting member to move.

10 Claims, 11 Drawing Sheets

STACKING APPARATUS, FEEDING APPARATUS, AND IMAGE FORMING APPARATUS

BACKGROUND OF THE INVENTION

Field of the Invention

The present invention relates to a stacking apparatus, a feeding apparatus, and an image forming apparatus capable of stacking a sheet as an image forming target.

Description of the Related Art

Some image forming apparatuses such as a copying machine and printer have an arrangement which includes a sheet storage unit and a feeding unit such as a feeding roller for feeding sheets stored in the sheet storage unit, and feeds a sheet stored in the sheet storage unit to an image forming unit by the feeding unit. Recently, image forming apparatuses including a large-capacity sheet storage unit into which a large number of sheets such as thousands of sheets can be replenished are increasing in number. Also, in the recent printing market, needs for performing printing on elongated paper sheets longer than regular-size paper sheets such as A3 and A4 are increasing (for example, a book cover, facing pages of a catalogue, and POP advertisement).

In a conventional sheet feeding apparatus that supports elongated paper sheets, a plurality of paper stacking lifters which are independently operable are arranged, and removable partition plates are provided in common use. Each partition plate has a function of preventing stacked sheets from collapsing or mixing in size (Japanese Patent Laid-Open No. 2003-63719).

In a conventional arrangement, however, if a partition plate is removed when a user uses a paper stacking lifter on one side, he/she needs to attach the partition plate again, impairing usability. Moreover, if an elongated paper sheet is to be fed in a state in which the partition plate is always mounted, an internal atmosphere between the paper stacking lifters is blocked. That is, a recent feeding apparatus needs to support various paper types, and as measures against paper having a high friction coefficient among pieces of paper, such as coated paper in particular, an air flow may be generated inside by using, for example, a heat source such as a cassette heater, a fan, or the like. In the conventional arrangement, however, internal air permeability becomes deteriorated due to the partition plate, so heat or the internal air flow cannot be circulated well.

SUMMARY OF THE INVENTION

The present invention provides a stacking apparatus, a feeding apparatus, and an image forming apparatus capable of keeping air permeability satisfactorily while improving usability with a simple arrangement.

The present invention in one aspect provides a stacking apparatus capable of stacking, as a sheet fed to a predetermined apparatus, a first sheet and a second sheet having a larger size than the first sheet in a feeding direction in which the sheet are fed to the predetermined apparatus, the stacking apparatus comprising: a first stacking unit configured to stack the first sheet; a second stacking unit configured to be able to move at a height which is equal to or higher than a predetermined height and stack the second sheet in cooperation with the first stacking unit at a height which is equal to or higher than the predetermined height; a limiting unit configured to move along the feeding direction and limit a trailing edge of a stacked sheet in the feeding direction; and a partition member configured to partition a space at a height which is lower than the predetermined height, into a first space corresponding to the first stacking unit and a second space corresponding to the second stacking unit in the feeding direction, wherein the partition member includes a first opening portion for communicating the first space and the second space with each other, and a second opening portion that allows the limiting unit to move.

The present invention can keep air permeability satisfactory while improving usability with the simple arrangement.

Further features of the present invention will become apparent from the following description of exemplary embodiments with reference to the attached drawings.

DESCRIPTION OF THE EMBODIMENTS

Figure 1:
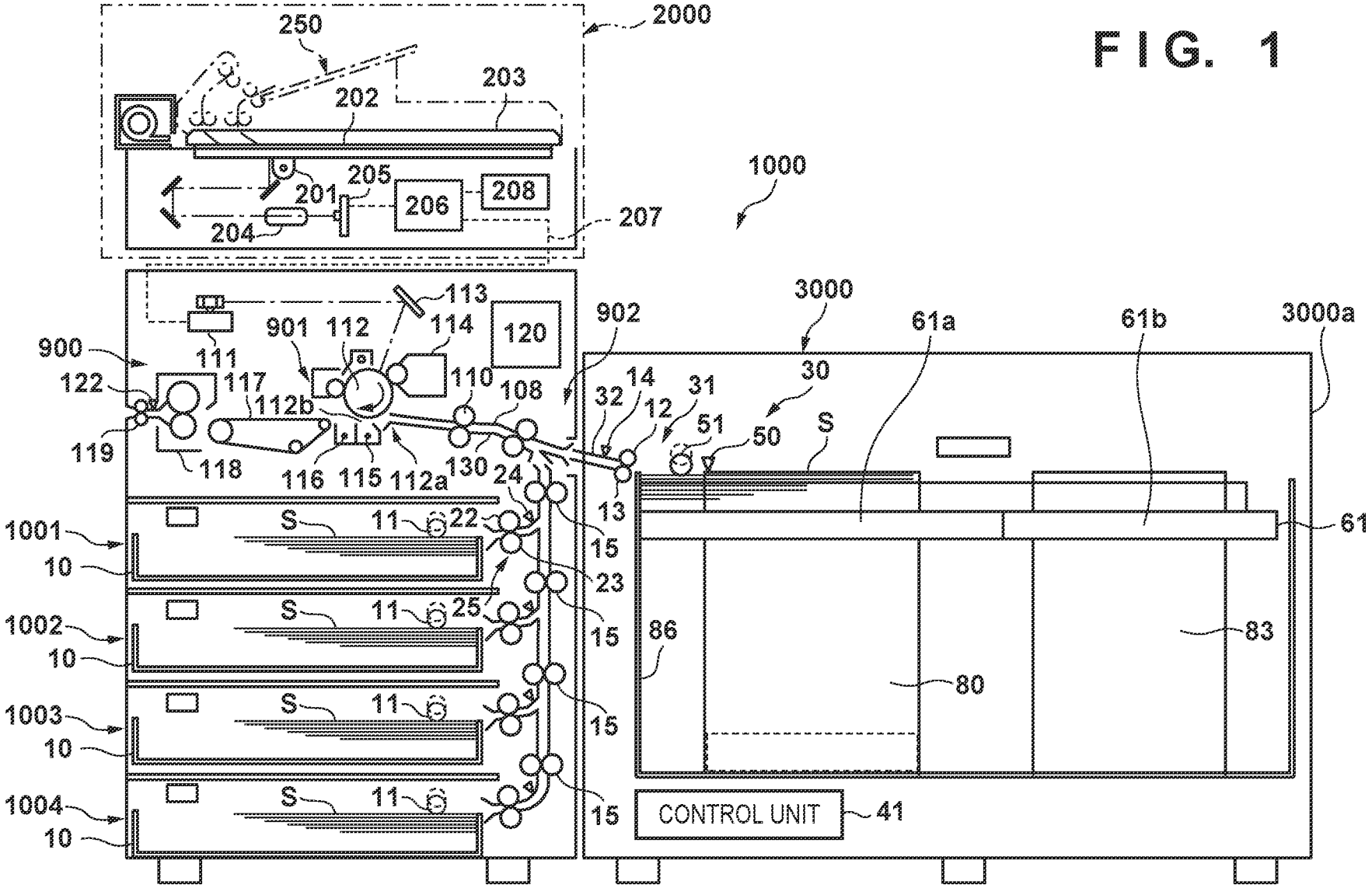
FIG. 1 is a schematic sectional view showing an image forming apparatus including a sheet feeding apparatus.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same constituent elements, and an explanation thereof will be omitted.

FIG. 1 is a schematic sectional view showing an image forming apparatus including a sheet feeding apparatus according to an embodiment of the present invention. An image forming system 1000 includes an image forming apparatus 900, a scanner apparatus 2000 arranged on the upper surface of the image forming apparatus 900, and a paper deck 3000 connected to the image forming apparatus 900.

The scanner apparatus 2000, which reads a document, includes a scanning optical system light source 201, a platen glass 202, an openable/closable document press plate 203, a lens 204, a light-receiving element (photoelectric conversion element) 205, an image processor 206, a memory unit 208, and the like. The memory unit 208 stores an image processing signal processed by the image processor 206.

When reading a document, the scanner apparatus 2000 reads a document (not shown) placed on the platen glass 202 by irradiating the document with light from the scanning optical system light source 201. A read document image is processed by the image processor 206, converted into an electrical signal 207 which is electrically encoded, and transmitted to a laser scanner 111 in the image forming apparatus 900.

Note that it is also possible to temporarily store the image information processed by the image processor 206 and encoded in the memory unit 208, and transmit the stored information to the laser scanner 111 as needed in accordance with a signal from a controller 120 (to be described later). Note also that the paper deck 3000 includes a control unit 41 which controls the paper deck 3000 in accordance with a command from the controller 120, and includes a CPU, a RAM, and a ROM.

The image forming apparatus 900 includes first to fourth sheet feeding apparatuses 1001 to 1004 for feeding sheets S, and a sheet conveying apparatus 902 for conveying the sheets S fed from the sheet feeding apparatuses 1001 to 1004 to an image forming unit 901. The image forming apparatus 900 includes the controller 120 which controls the individual units of the image forming system 1000, and includes a CPU, a RAM, and a ROM.

Each of the first to fourth sheet feeding apparatuses 1001 to 1004 includes a feeding cassette 10 for storing the sheets S, a pickup roller 11, and a separation conveyor roller pair 25 including a feed roller 22 and a retard roller 23. The sheets S stored in the feeding cassette 10 are separately fed one by one by the pickup roller 11 which performs a vertical moving operation and rotates at a predetermined timing, and the separation conveyor roller pair 25.

In addition, a feed sensor 24 is arranged near the downstream side of the feed roller 22 and retard roller 23 in the sheet feeding direction. The feed sensor 24 senses the passing of the sheet S, and transmits a sensing signal to the controller 120.

The sheet conveying apparatus 902 includes a conveyor roller pair 15, a pre-registration roller pair 130, and a registration roller pair 110. The sheet S fed from the sheet feeding apparatuses 1001 to 1004 is passed through a sheet conveyance path 108 by the conveyor roller pair 15 and the pre-registration roller pair 130, and guided to the registration roller pair 110. After that, the registration roller pair 110 supplies the sheet S to the image forming unit 901 at a predetermined timing.

The image forming unit 901 includes a photosensitive drum 112, the laser scanner 111, a developing device 114, a transfer charging device 115, a separation charging device 116, and the like. In image formation, a mirror 113 reflects a laser beam from the laser scanner 111, and the photosensitive drum 112 rotating clockwise is irradiated with the laser beam, thereby forming an electrostatic latent image on the photosensitive drum. Then, the electrostatic latent image formed on the photosensitive drum is developed as a toner image by the developing device 114.

This toner image on the photosensitive drum is transferred onto the sheet S by the transfer charging device 115 in a transfer unit 112*b*. Furthermore, the sheet S onto which the toner image is thus transferred is electrostatically separated from the photosensitive drum 112 by the separation charging device 116, conveyed by a conveyor belt 117 to a fixing apparatus 118 where the toner image is fixed, and then discharged by discharge rollers 119. The image forming unit 901 and the fixing apparatus 118 form an image on the sheet S fed from a sheet feeding apparatus 30 (or the sheet feeding apparatuses 1001 to 1004).

In addition, a discharge sensor 122 is arranged in a conveyance path between the fixing apparatus 118 and the discharger rollers 119. The controller 120 detects the passing of the discharged sheet S based on a sensing signal from this discharge sensor 122.

Note that the image forming apparatus 900 and the scanner apparatus 2000 are formed as discrete units in this embodiment, but the image forming apparatus 900 and the scanner apparatus 2000 may also be integrated. Note also that regardless of whether the image forming apparatus 900 and the scanner apparatus 2000 are separated or integrated, the image forming apparatus 900 functions as a copying machine when a processing signal of the scanner apparatus 2000 is input to the laser scanner 111, and functions as a FAX apparatus when a FAX transmission signal is input to the laser scanner 111. Furthermore, the image forming apparatus 900 also functions as a printer when a signal from a personal computer (PC) is input to the image forming apparatus 900.

Conversely, the image processing apparatus 900 functions as a FAX apparatus when transmitting a processing signal of the image processor 206 of the scanner apparatus 2000 is transmitted to another FAX apparatus. In addition, if an automatic document feeder (ADF) 250 as indicated by the alternate long and two short dashed lines is used instead of the press plate 203 in the scanner apparatus 2000, documents (not shown) can be fed and read in succession.

Figure 2:
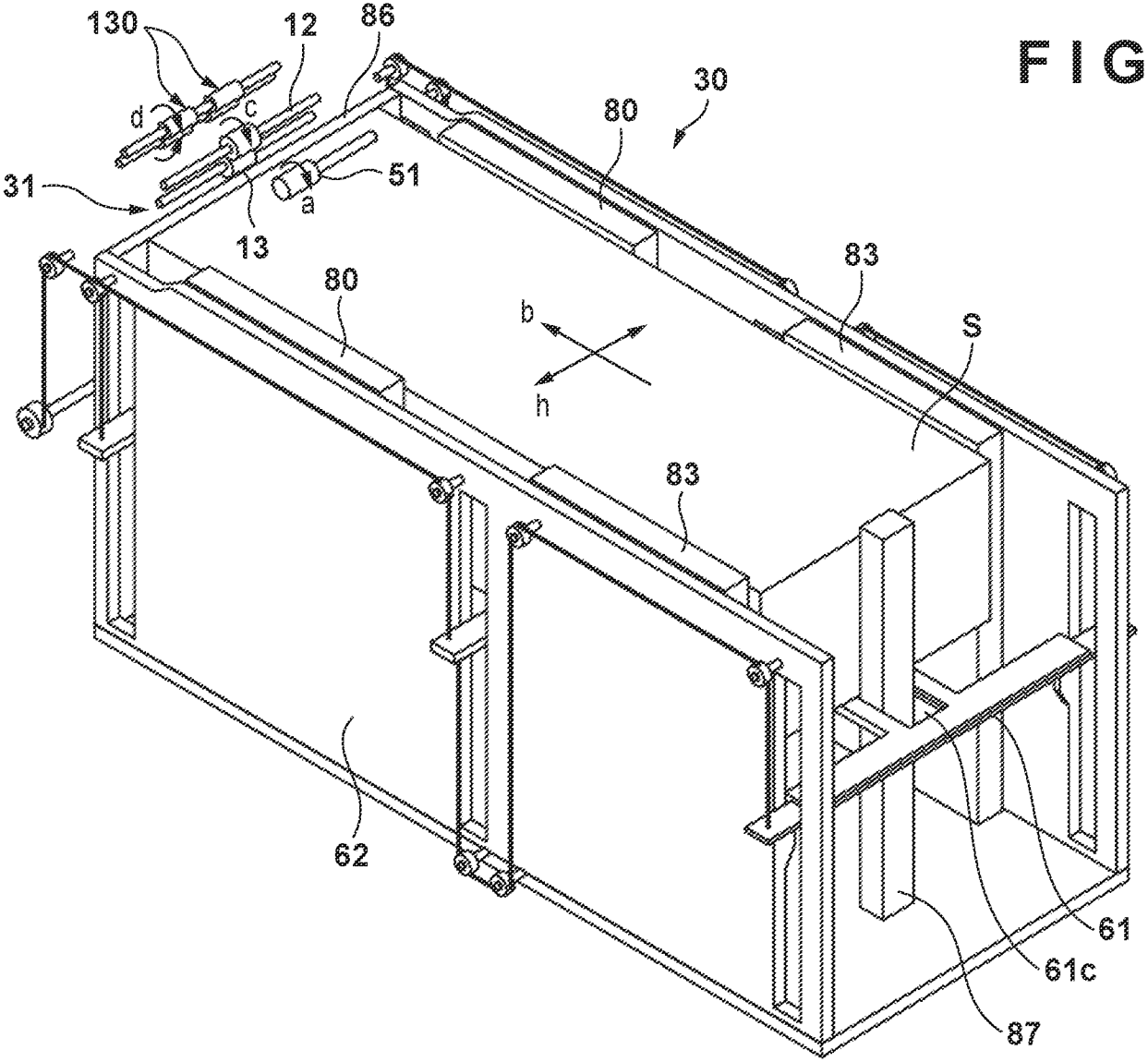
FIG. 2 is a perspective view showing main parts of a paper deck.

Next, the sheet feeding apparatus 30 of the image forming system 1000 according to this embodiment will be explained by taking the paper deck 3000 as a large-capacity deck as an example. FIG. 2 is a perspective view showing main parts of the paper deck 3000 with an exterior cover being removed.

As shown in FIGS. 1 and 2, the paper deck 3000 includes a main body 3000*a*, a large-capacity deck storage 62 accommodated in the main body 3000*a*, and the sheet feeding apparatus 30. This sheet feeding apparatus 30 feeds the sheets S stacked and accommodated in the large-capacity deck storage 62 to the image forming unit 901.

The sheet feeding apparatus 30 includes a pickup roller 51 for feeding the sheets S stacked in a main lifter 61*a* (first stacking unit) on which sheets SS of regular-size paper (to be referred to as plain paper hereinafter) are stacked and an extension lifter 61*b* (second stacking unit) which is used to feed sheets SL of large-size paper (elongated paper) (to be referred to as a lifter 61 altogether hereinafter), and a separation conveyor roller pair 31 which are formed by a feed roller 12 and a retard roller 13. The extension lifter 61*b* is used to extend a stacking area of the main lifter 61*a* onto a conveyance direction. The pickup roller 51 is arranged to be able to come into pressure contact with the uppermost sheet on the lifter 61 by applying an appropriate force to the sheet near the distal end portion in the sheet feeding direction (the direction of an arrow b). The pickup roller 51 is positioned above the lifter 61, abuts against the uppermost one of the sheets S stacked on the lifter 61 having moved upward, and feeds the uppermost sheet.

Sheets can be stacked on the lifter 61. The lifter 61 is supported by a driving mechanism 54 (FIG. 6) including a vertical movement motor 55 so as to be movable upward and downward. In addition, an upper surface sensor 50 is arranged on the upstream side of the pickup roller 51 above the lifter 61. The upper surface sensor 50 is positioned above the lifter 61, and senses the sheets S on the stacking member.

The sheet feeding apparatus 30 includes the lifter 61, and two pairs of side limiting members 80 and 83. The side limiting members 80 and 83 can limit the side edge positions of the sheets S stacked on the lifter 61 in the widthwise direction (the direction of an arrow h in FIG. 2) perpendicular to the feeding direction (the direction of the arrow b in FIG. 2), and both of the side limiting members 80 and 83 can move in the widthwise direction.

In this embodiment, the pickup roller 51 can come into pressure contact with the uppermost one of the sheets S on the stacking member by applying an appropriate force to the uppermost sheet. The sheets S on the lifter 61 are separately fed one by one by the pickup roller 51 which vertically moves and rotates at a predetermined timing and the separation conveyor roller pair 31.

A connecting conveyance path 32 for feeding the sheet S from the paper deck 3000 to the pre-registration roller pair 130 of the image forming apparatus 900 is arranged in that portion of the paper deck 3000, which is connected to the image forming apparatus 900.

In the large-capacity deck storage 62, the two pairs of side limiting members 80 and 83 arranged on the two sides in the direction (the widthwise direction in this embodiment) perpendicular to the sheet feeding direction (the direction of the arrow b) are arranged. The two pairs of side limiting members 80 and 83 can slide to the widths of all sheet sizes corresponding to the specifications, and can guide the sheets S on the lifter 61. That is, the side limiting members 80 and 83 are so supported as to be movable in the widthwise direction, and limit the two side positions of the stacked sheets S by abutting against the two side edges of the sheets S. Note that a leading edge limiting member 86 in FIG. 2 limits the leading edges of the sheets S on the lifter 61.

Also, a trailing edge limiting member 87 is so arranged as to limit the trailing edges of the sheets S on the lifter 61. The trailing edge limiting member 87 is so supported as to be movable parallel to the sheet feeding direction (the direction of the arrow b), and limits the trailing edge positions of the sheets S. The trailing edge limiting member 87 can move along a positioning elongated hole 61*c* (FIG. 2) formed in the central portion of the lifter 61.

As shown in FIG. 2, when the pickup roller 51 is driven by a driving unit (not shown) to rotate in the direction of feeding the sheets S (the direction of an arrow a), the uppermost sheet S is fed in the direction of the arrow b. Consequently, the sheet S abuts against the nip portion of the separation conveyor roller pair 31 adjacent to the exit side of the pickup roller 51.

If multi feed occurs on the sheets S fed by the pickup roller 51, the following operation is performed. That is, the retard roller 13 which rotates in the direction opposite to that of the feed roller 12 which rotates in the same direction (the direction of an arrow c) as the arrow a rotates in the same direction as that of the feed roller 12 if two or more sheets S abut against the nip portion. Then, the retard roller 13 pushes the second and subsequent sheets S in the nip portion back in the direction of the lifter 61, and the feed roller 12 feeds only a single uppermost sheet S in the direction of the arrow b.

When the sheet S is fed from the paper deck 3000 having the above arrangement or from one of the first to fourth sheet feeding apparatuses 1001 to 1004, the leading edge of the sheet S abuts against the nip portion of the pre-registration roller pair 130. The pre-registration roller pair 130 includes a pair of opposite rollers, and is arranged on the conveyance path of the sheets S so as to be rotatable in the direction of an arrow d in FIG. 2 by a driving unit (not shown). The sheet S which once abuts against the nip portion of the pre-registration roller pair 130 is conveyed into the image forming apparatus 900 by the roller pair 130, which rotates in synchronism with the feed timing.

Figure 5A:
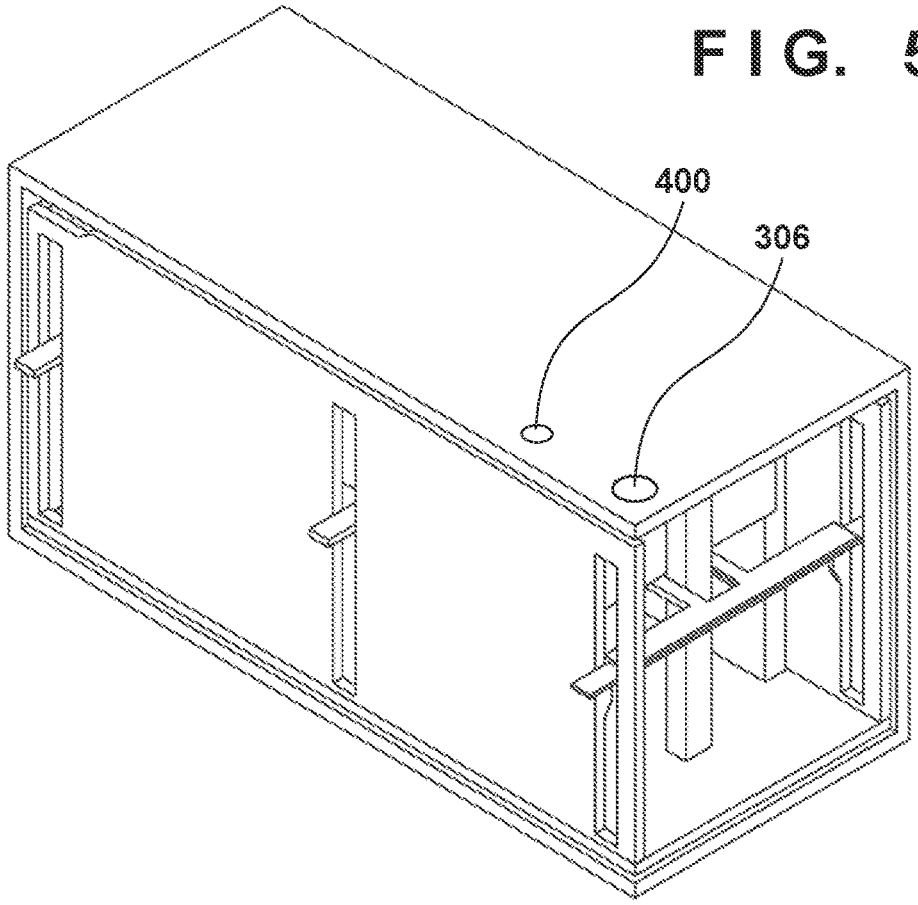
FIGS. 5A and 5B are views each showing a retracted state of a large-capacity deck storage.
Figure 5B:
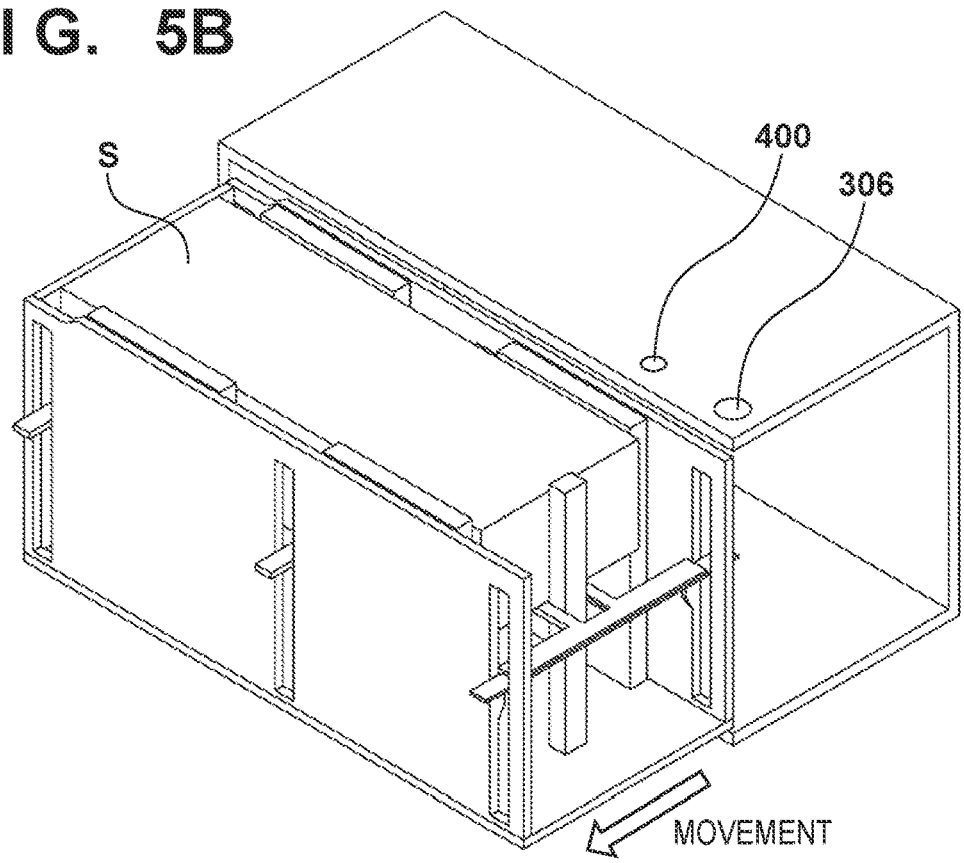

FIG. 5A is a view showing a state in which the large-capacity deck storage 62 is retracted in the paper deck 3000. A storage opening/closing button 306 is a button for accepting an instruction to pull out the large-capacity deck storage 62. The large-capacity deck storage 62 can be pulled out when the user presses the storage opening/closing button 306. FIG. 5B is a view showing a state in which the large-capacity deck storage 62 is pulled out to the front side from the paper deck 3000. The large-capacity deck storage 62 is pulled out as shown in FIG. 5B when, for example, the user replenishes sheets, removes sheets remaining in the lifter 61, or performs mode switching (to be described later). As will be described later, the paper deck 3000 includes an LED 400 for notifying the user of the states of the main lifter 61*a* and extension lifter 61*b*.

The lifter 61 includes the main lifter 61*a* and the extension lifter 61*b*. As shown in FIG. 2, a plurality of wires are connected to the wire fulcrums of the main lifter 61*a*, and the main lifter 61*a* is suspended by these wires. When the wires are wound by a winding unit connected to a motor, the lifter 61 moves upward. When the wires are fed, the lifter 61 moves downward.

Figure 3A:
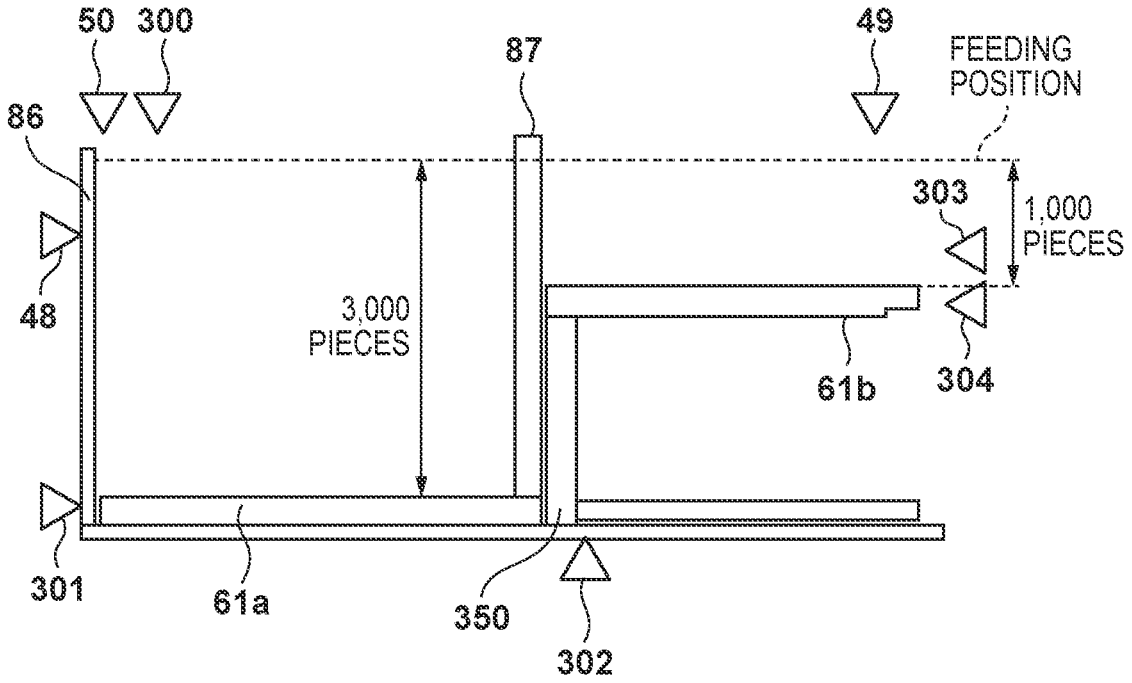
FIGS. 3A and 3B are views each showing a positional relationship of lifters.

The extension lifter 61*b* is installed as it is supported by a partition plate 350 and the large-capacity deck storage 62, as shown in FIGS. 2 and 3A. The extension lifter 61*b* itself has no driving power. For example, when the main lifter 61*a* exists above the support height of the extension lifter 61*b*, the extension lifter 61*b* is coupled with the main lifter 61*a* and moves together with the main lifter 61*a*. On the other hand, when the main lifter 61*a* exists below the support height of the extension lifter 61*b*, the extension lifter 61*b* waits at the support height.

This support height is set in consideration of the driving power and strength of the lifter 61. This step between the lifters makes the number of elongated paper sheets SL to be stacked fall within the allowable range of the sheet feeding apparatus 30.

Figure 6:
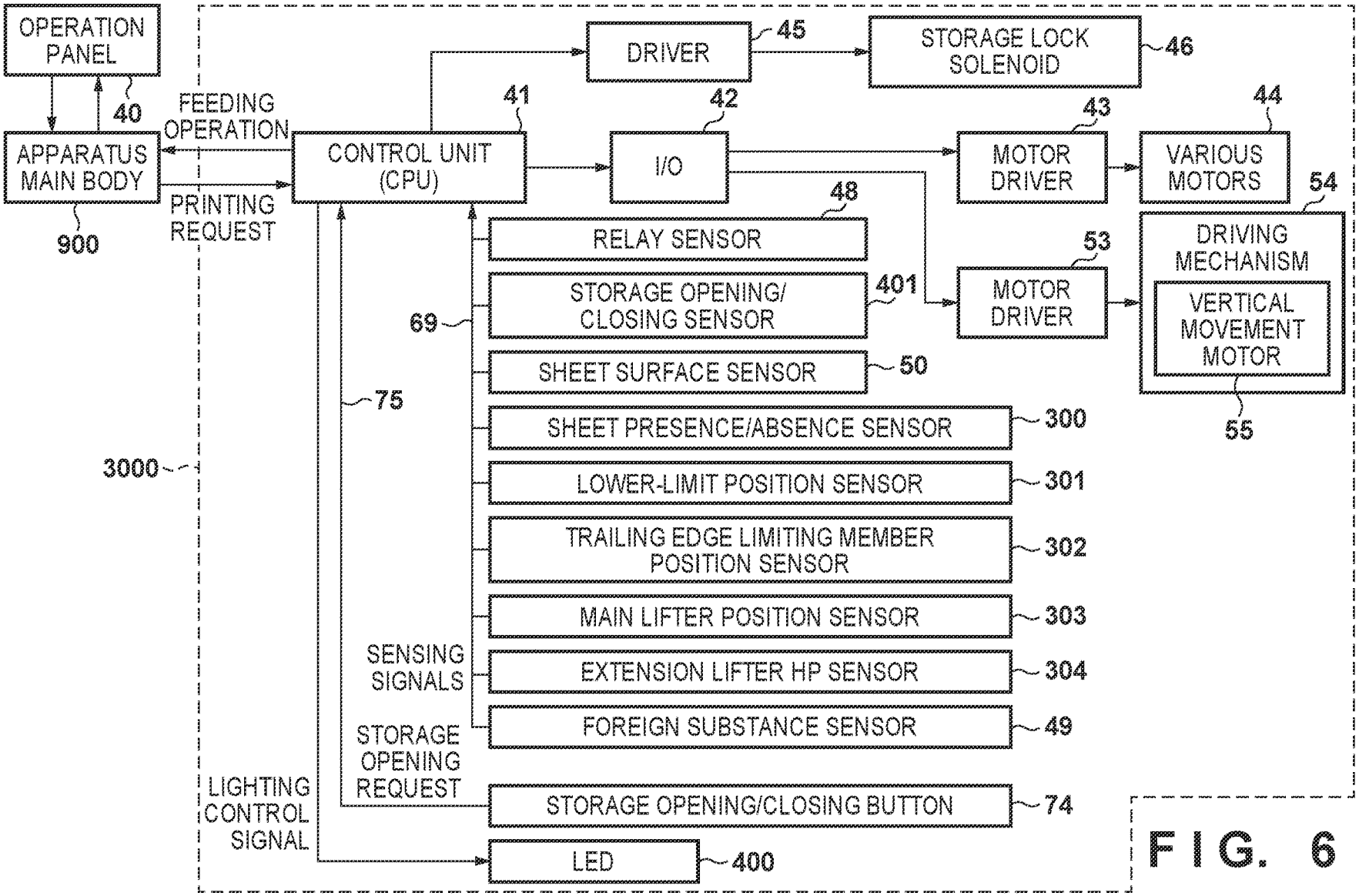
FIG. 6 is a block diagram showing the arrangement of a control system of the paper deck.

FIG. 6 is a view showing the block configuration of the image forming system 1000 for implementing the operation of this embodiment. FIG. 6 shows the paper deck 3000, the image forming apparatus 900, and an operation panel 40.

The operation panel 40 displays various user interface screens such as apparatus information, a setting screen, and job information, and accepts instructions and setting operations from the user. The operation panel 40 is formed on, for example, the image forming apparatus 900. The image forming apparatus 900 issues a printing request to the control unit 41 of the paper deck 3000. When receiving this printing request from the image forming apparatus 900, the control unit 41 performs a feeding operation for the image forming apparatus 900. Alternatively, the image forming apparatus 900 may include the control unit 41.

The control unit 41 comprehensively controls the paper deck 3000. For example, when receiving an opening request signal input by the user by pressing the storage opening/closing button 306, the control unit 41 cancels the locked state of a storage lock solenoid 46 via a driver 45, thereby opening the large-capacity deck storage 62. The control unit 41 drives various motors 44 on the sheet conveyance path via a motor driver 43 connected to an input/output interface (I/O) 42. Also, the control unit 41 controls the driving mechanism 54 for vertically moving the main lifter 61*a* and the extension lifter 61*b* via a motor driver 53 connected to the input/output interface (I/O) 42. The driving mechanism 54 includes the vertical movement motor 55. The vertical movement motor 55 drives the winding unit (not shown).

Sensing signals from a relay sensor 48, a storage opening/closing sensor 401, the upper surface sensor 50, and a sheet presence/absence sensor 300 are transmitted to the control unit 41. The storage opening/closing sensor 401 is a sensor for sensing the opening/closing state of the storage. Sensing signals from a lower-limit position sensor 301, a trailing edge limiting member position sensor 302, a main lifter position sensor 304, an extension lifter HP sensor 303, and a foreign substance sensor 49 are transmitted to the control unit 41. In addition, a storage opening request signal generated by the user by pressing the storage opening/closing button 306 is transmitted to the control unit 41.

The control unit 41 controls lighting of the LED 400 by a lighting control signal. For example, in accordance with a plain paper mode/elongated paper mode, the control unit 41 controls lighting of the LED 400 based on a predetermined pattern.

A difference between two modes which the sheet feeding apparatus 30 uses in accordance with the types of sheets to be stacked will be explained below. In this embodiment, the types of sheets are roughly classified into two types. One is a plain paper sheet such as A3 and A4, and the other is an elongated paper sheet longer than the plain paper sheet in the feeding/conveyance direction. Sheets to be stacked on the lifter 61 are sorted into plain and elongated paper sheets in accordance with the position of the trailing edge limiting member 87. A trailing edge limiting member position sensor 302 senses the position of the trailing edge limiting member 87.

Figure 4A:
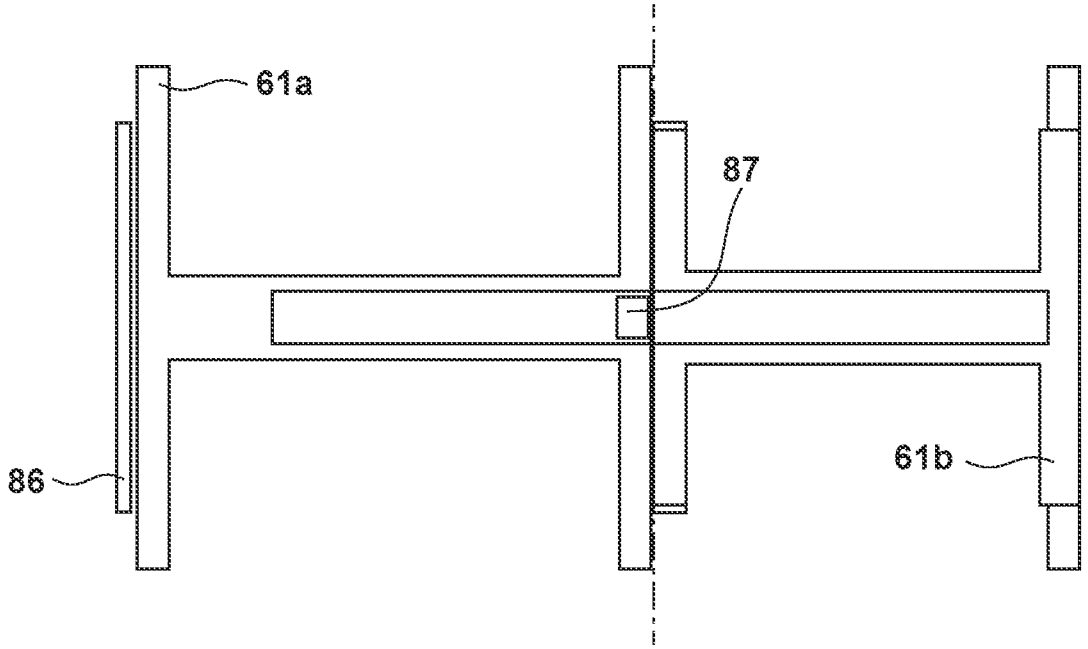
FIGS. 4A and 4B are views each showing the position of a trailing edge limiting plate.

When the trailing edge limiting member 87 exists on the left side of the alternate long and short dashed line as shown in FIG. 4A, it is determined that sheets to be stacked on the lifter 61 are plain paper sheets. This state is called a plain paper mode. In this plain paper mode, as shown in FIG. 3A, the main lifter 61*a* can move downward to a lower-limit position sensible by the illustrated lower-limit position sensor 301, so a large amount of sheets can be stacked. For example, if the main lifter 61*a* moves downward to a position sensible by the lower-limit position sensor 301, 3,000 plain paper sheets can be stacked.

Figure 3B:
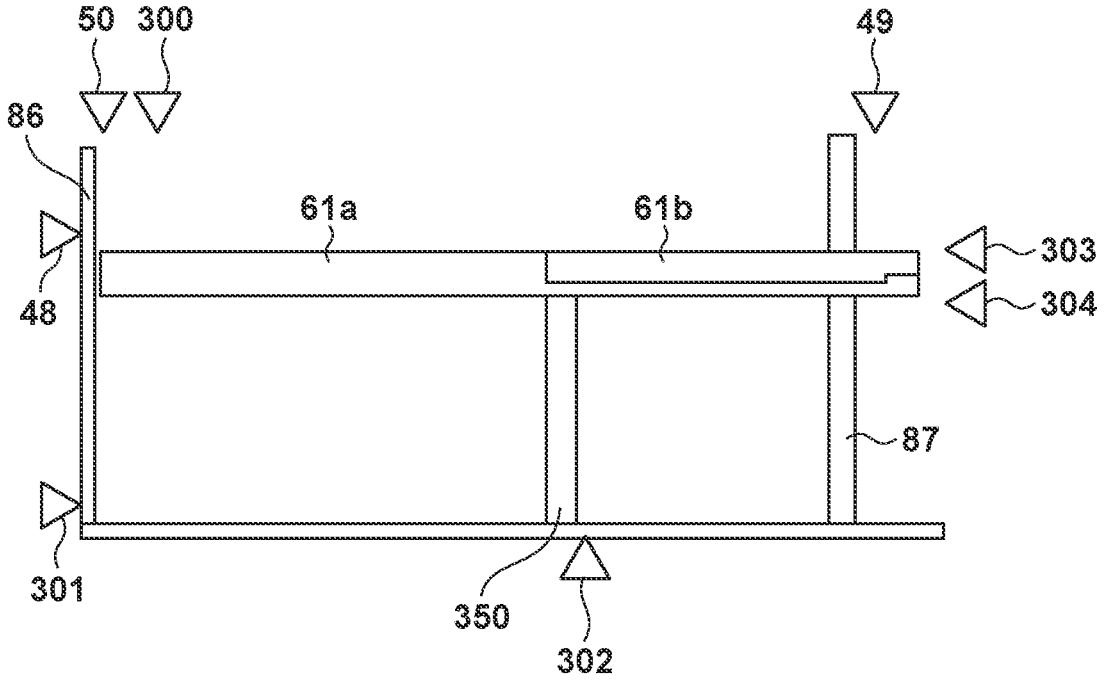
Figure 4B:
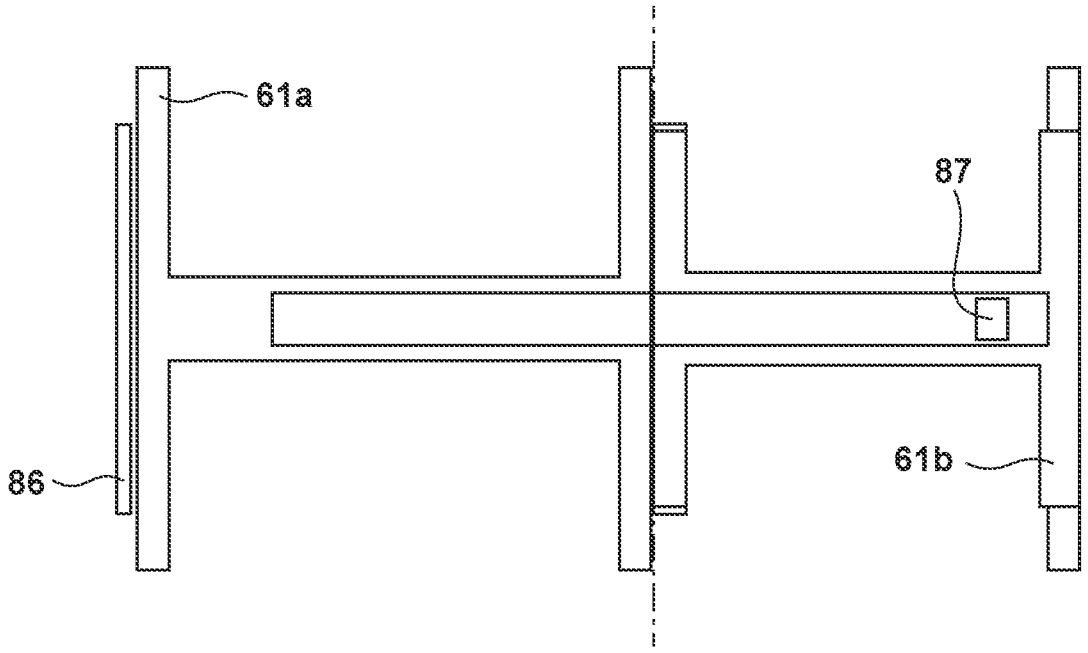

When the trailing edge limiting member 87 exists on the right side of the alternate long and short dashed line as shown in FIG. 4B, it is determined that sheets to be stacked on the lifter 61 are elongated paper sheets. This state will be called an elongated paper mode. In this elongated paper mode, as shown in FIG. 3B, the lifter 61 can move downward only to a position sensible by an extension lifter HP sensor 303, so the number of stackable sheets is restricted compared to that of the plain paper mode. For example, while 3,000 plain paper sheets can be stacked, the number of stackable elongated paper sheets is limited to 1,000.

An operation when a user using an elongated paper sheet switches to use of a plain paper sheet will be described below with reference to FIG. 7. As described above, the elongated paper mode can be switched to the plain paper mode when the user moves the trailing edge limiting member 87 from the right side to the left side of the alternate long and short dashed line as shown in FIGS. 4A and 4B.

Figure 7:
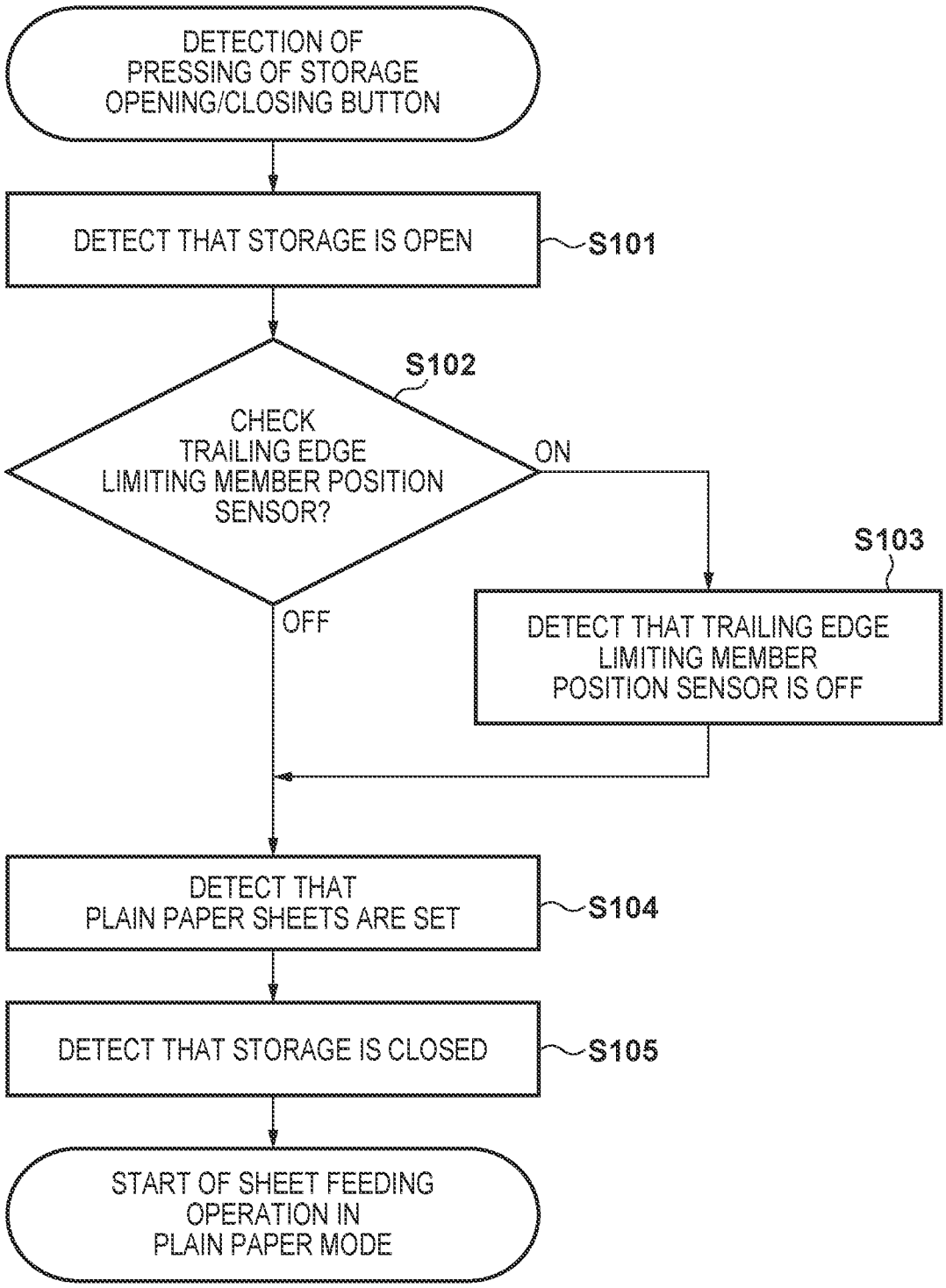
FIG. 7 is a flowchart showing a process of starting a feeding operation.

Processing in FIG. 7 is started when the user presses the storage opening/closing button 306. In step S101, the CPU 41 sets the large-capacity deck storage 62 in an open state (withdrawable state). In step S102, the CPU 41 determines whether the trailing edge limiting member position sensor 302 is in an ON state or an OFF state. If the CPU 41 determines here that the trailing edge limiting member position sensor 302 is in the ON state, the process advances to step S103. If the CPU 41 determines here that the trailing edge limiting member position sensor 302 is in the OFF state, the process advances to step S104. In step S103, the CPU 41 turns on the LED 400 and notifies the user that the elongated paper mode is set. A lighting pattern at this time is predetermined, and the user can identify that the elongated paper mode is set in accordance with the notification by the LED 400. The process advances to step S104 when the user moves the trailing edge limiting member 87 from the right side to the left side of the alternate long and short dashed line as shown in FIGS. 4A and 4B, and the CPU 41 detects that the trailing edge limiting member position sensor 302 is in the OFF state.

In step S104, when the user sets plain paper sheets, the CPU 41 detects that the plain paper sheets are set. Then, when the user closes the large-capacity deck storage 62, in step S105, the CPU 41 detects that the large-capacity deck storage 62 is in a closed state. Subsequently, a feeding operation in the plain paper mode is started.

An operation when a user using a plain paper sheet switches to use of an elongated paper sheet will be described next with reference to FIG. 8. As described above, the plain paper mode can be switched to the elongated paper mode when the user moves the trailing edge limiting member 87 from the left side to the right side of the alternate long and short dashed line as shown in FIGS. 4A and 4B.

Figure 8:
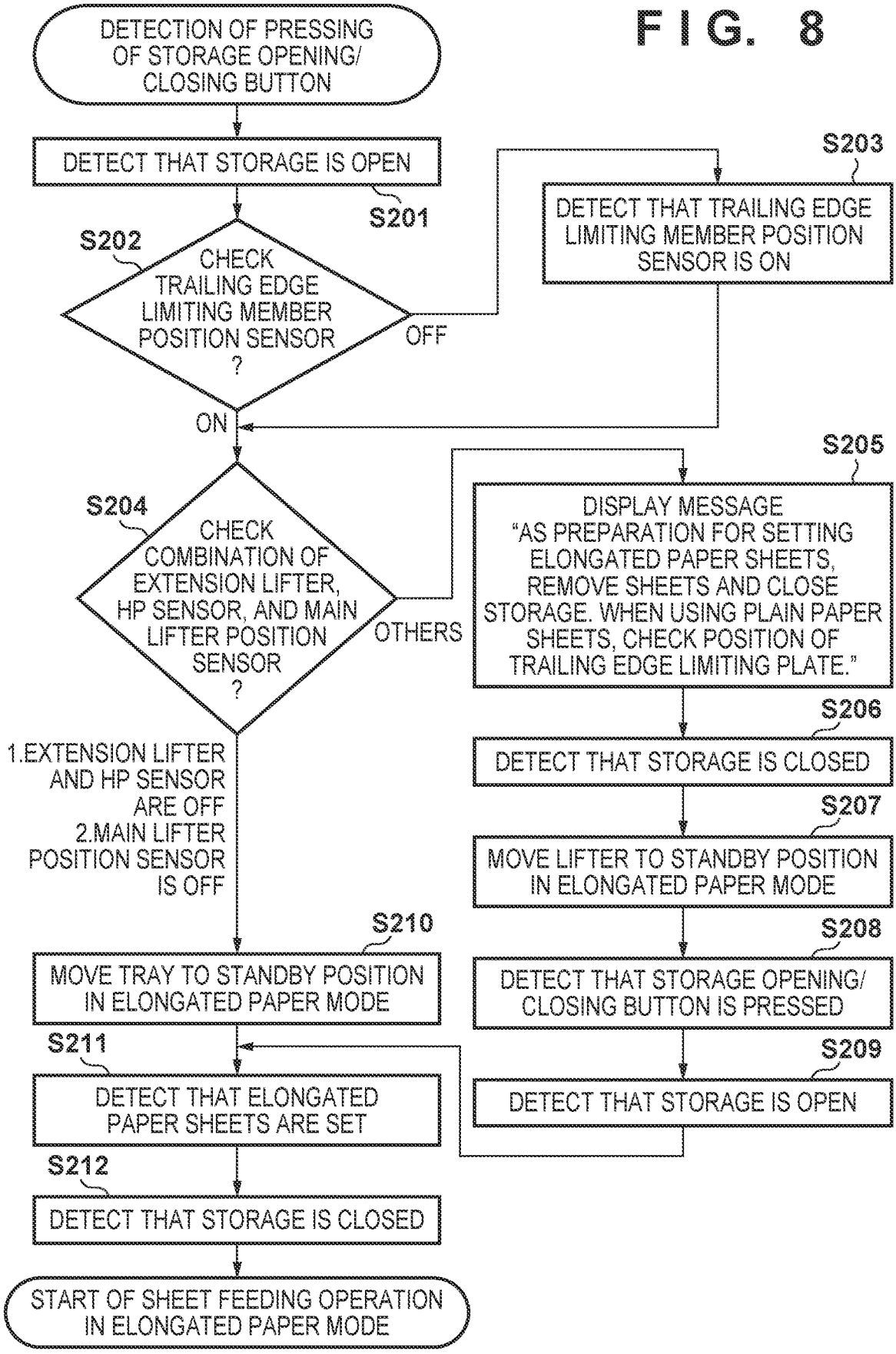
FIG. 8 is a flowchart showing a process of starting a feeding operation.

Processing in FIG. 8 is started when the user presses the storage opening/closing button 306. In step S201, the CPU 41 sets the large-capacity deck storage 62 in the open state (withdrawable state). In step S202, the CPU 41 determines whether the trailing edge limiting member position sensor 302 is in the ON state or the OFF state. If the CPU 41 determines here that the trailing edge limiting member position sensor 302 is in the OFF state, the process advances to step S203. If the CPU 41 determines here that the trailing edge limiting member position sensor 302 is in the ON state, the process advances to step S204. In step S203, the CPU 41 turns on the LED 400 and notifies the user that the plain paper mode is set. A lighting pattern at this time is predetermined, and the user can identify that the plain paper mode is set in accordance with the notification by the LED 400. The process advances to step S204 when the user moves the trailing edge limiting member 87 from the left side to the right side of the alternate long and short dashed line as shown in FIGS. 4A and 4B, and the CPU 41 detects that the trailing edge limiting member position sensor 302 is in the ON state.

In step S204, the CPU 41 checks the combination of sensing results from the extension lifter HP sensor 303 and main lifter position sensor 304. When both the extension lifter HP sensor 303 and the main lifter position sensor 304 are OFF, the process advances to step S210. In this case, both the main lifter 61*a* and the extension lifter 61*b* are located above the extension lifter HP sensor 303 and the main lifter position sensor 304. In this case, in step S210, the CPU 41 moves the main lifter 61*a* to a standby position in the elongated paper mode as shown in FIG. 3B. After step S210, the process advances to step S211.

If the combination of the sensing results is a combination other than the above-described combination, the process advances to step S205. In this case, for example, plain paper sheets are stacked, and the main lifter 61*a* is located below the main lifter position sensor 304. In that state, a situation where the plain paper sheets remain is obtained. Therefore, in step S205, the CPU 41 displays, on the operation panel 40, a message "As preparation for setting elongated paper sheets, remove sheets and close the storage. When using plain paper sheets, check the position of the trailing edge limiting plate."

When the user removes sheets and closes the large-capacity deck storage 62 after displaying the message, in step S206, the CPU 41 detects that the large-capacity deck storage 62 is closed. In step S207, the CPU 41 moves the main lifter 61*a* to the standby position in the elongated paper mode as shown in FIG. 3B. After step S207, when the CPU 41 detects in step S208 that the user presses the storage opening/closing button 306, the CPU 41 sets the large-capacity deck storage 62 in the open state in step S209. After step S209, the process advances to step S211.

In step S211, when the user sets elongated paper sheets, the CPU 41 detects that the elongated paper sheets are set. Then, when the user closes the large-capacity deck storage 62, in step S212, the CPU 41 detects that the large-capacity deck storage 62 in the closed state. Subsequently, a feeding operation in the elongated paper mode is started.

The partition plate 350 and a cassette heater 351 will be described below. A recent feeding apparatus needs to support various paper types and needs a heat source (heating source) such as a cassette heater as measures against paper having a high friction coefficient among pieces of paper such as coated paper in particular.

Figure 12:
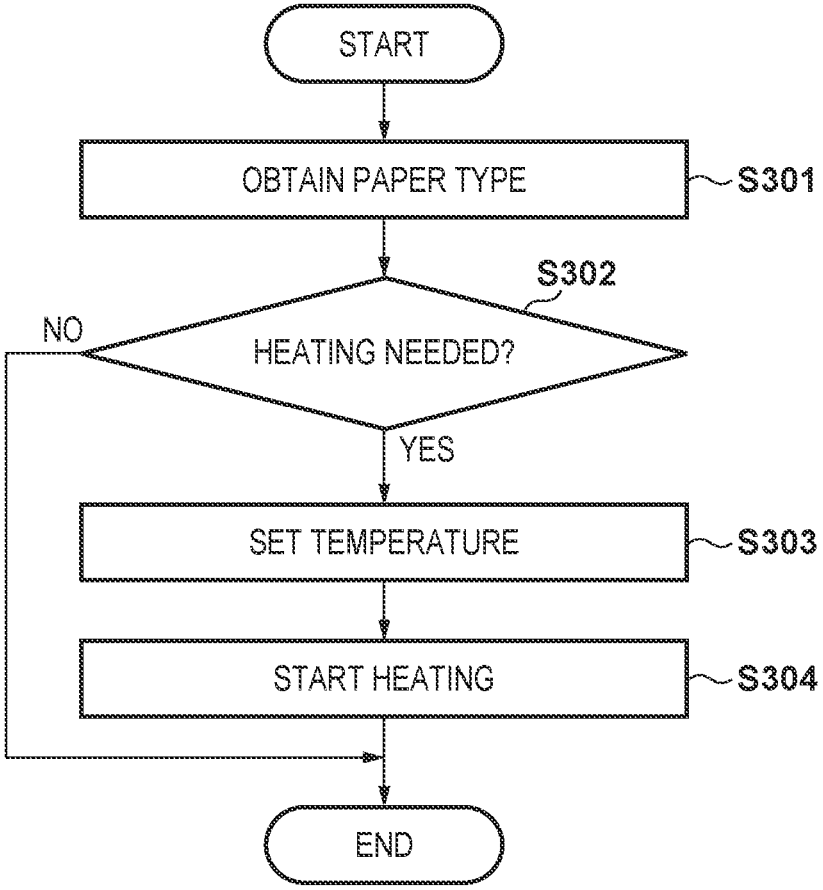
FIG. 12 is a flowchart showing control processing of a cassette heater 351.

FIG. 12 is a flowchart showing control processing of the cassette heater 351 according to this embodiment. Each process in FIG. 12 is implemented by, for example, the CPU 41 by reading out a program stored in the ROM and executing the program. When the image forming apparatus 900 and the paper deck 3000 are powered on, the processing in FIG. 12 is started.

In step S301, the CPU 41 obtains paper-type information accepted by a user input from the image forming apparatus 900. In step S302, based on the paper-type information obtained in step S301, the CPU 41 determines whether heating by the cassette heater 351 is needed. For example, if the type of paper which is comparatively thick such as coated paper is used, the CPU 41 determines that heating by the cassette heater 351 is needed.

If the CPU 41 determines in step S302 that heating is needed, in step S303, the CPU 41 sets a set temperature according to a paper type which is indicated by the information obtained in step S301. Then, in step S304, the CPU 41 starts heating by the cassette heater 351 at the set temperature. On the other hand, if the CPU 41 determines in step S302 that heating is not needed, the processing in FIG. 12 ends without performing heating by the cassette heater 351.

The heat source is generally installed so as to mainly warm the side of regular-size paper sheets which are used frequently. Therefore, a positional relationship among the cassette heater 351, main lifter 61*a*, extension lifter 61*b*, and partition plate 350 is as shown in FIG. 9.

Figure 9:
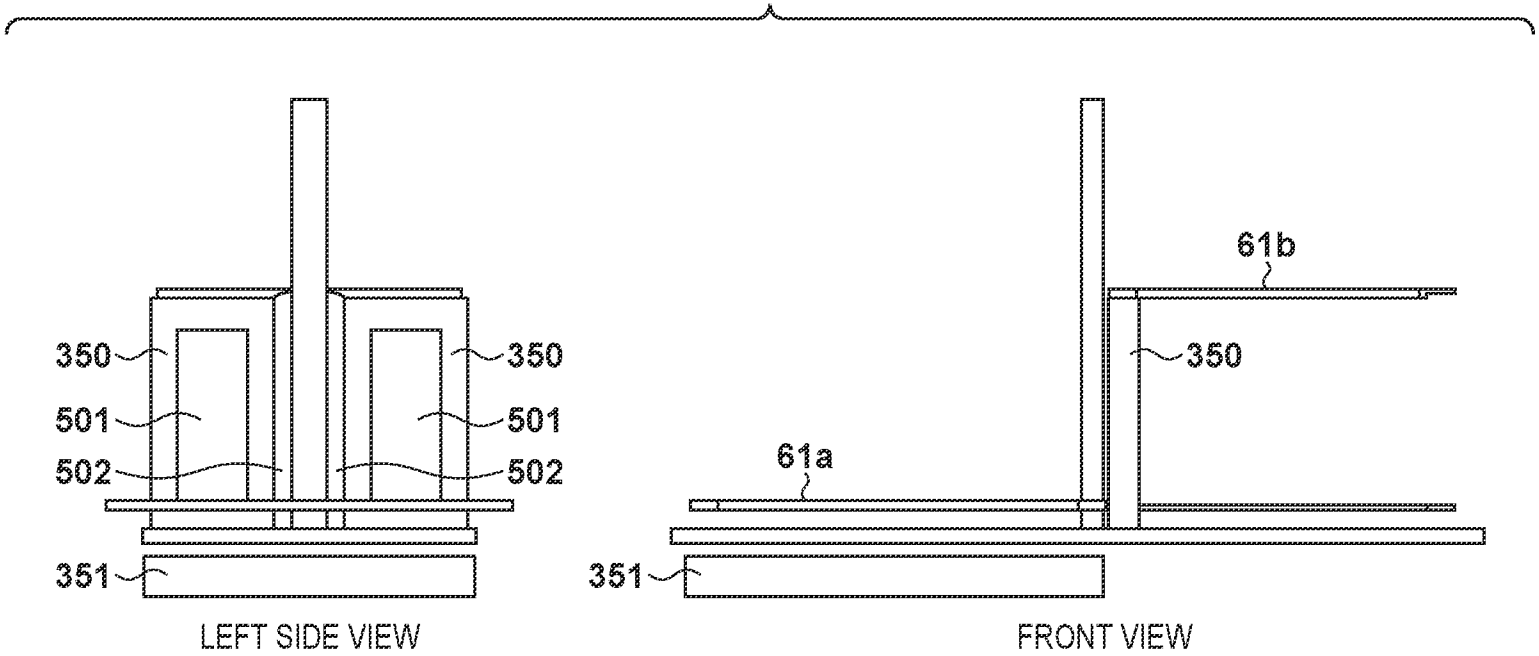
FIG. 9 shows views of a positional relationship between a partition plate and a cassette heater.

As shown in FIG. 9, the partition plate 350 is provided below the extension lifter 61*b*, so as to partition a region below where the extension lifter 61*b* is supported and a region where regular-size paper sheets are stacked. That is, in a state in which the main lifter 61*a* exists below the extension lifter 61*b*, the partition plate 350 is provided so as to partition the region of the main lifter 61*a* where the regular-size paper sheets are stacked and the region below where the extension lifter 61*b* is supported. Moreover, the partition plate 350 includes opening portions 502 for allowing the trailing edge limiting member 87 to move in the conveyance direction, and opening portions 501 each for connecting a space in a lower portion of the main lifter 61*a* and a space in a lower portion of the extension lifter 61*b*. Each opening portion 501 for connecting (communicating) the spaces is formed to have a size through which at least a first of an adult male can pass. Furthermore, at least two opening portions 501 are provided to sandwich the opening portions 502 in a sheet width direction, as shown in FIG. 9. The total of opening areas of the opening portions 501 is set to be larger than opening areas out of opening areas of the opening portions 502 when the trailing edge limiting member 87 is removed on a surface perpendicular to a sheet conveyance direction.

Figure 10:
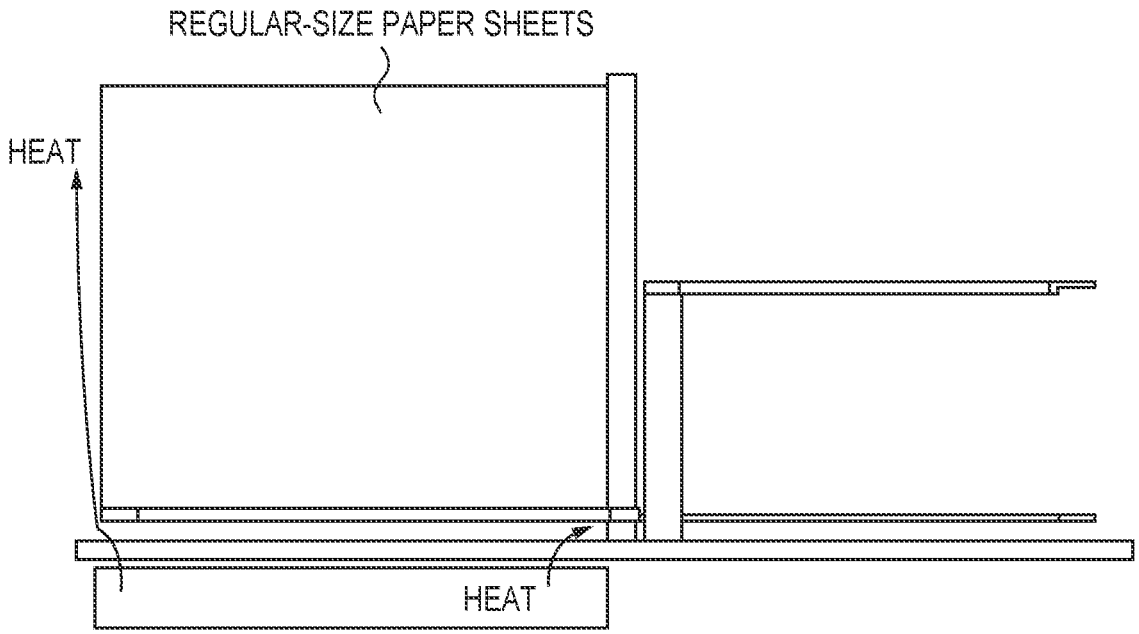
FIG. 10 is a view showing how the heat convects when regular-size paper sheets are stacked.

FIG. 10 is a view showing a state when regular-size paper sheets are stacked. When the regular-size paper sheets are stacked, because the paper sheets are stacked so as to block the opening portions 501 of the partition plate 350, heat generated from the cassette heater 351 remains on a side where the paper sheets are stacked without flowing through the space in the lower portion of the extension lifter 61*b*. When the main lifter 61*a* is located in a lowermost portion, the opening areas of the opening portions 501 are minimized (blocked). In a range where the main lifter 61*a* moves together with the extension lifter 61*b*, the opening areas of the opening portions 501 are maximized. Between the above-described two positions of the main lifter 61*a*, at least a part of each opening portion 501 is covered with the stacked sheets.

Figure 11:
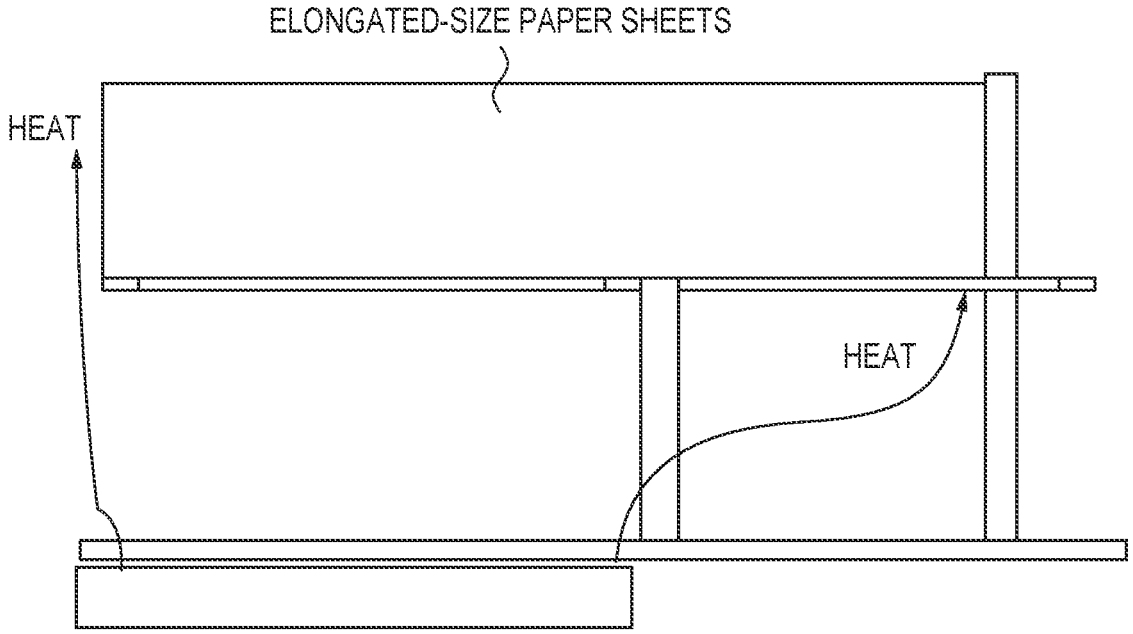
FIG. 11 is a view showing how the heat convects when elongated-size paper sheets are stacked.

FIG. 11 is a view showing a state when elongated-size paper sheets are stacked. When the elongated-size paper sheets are stacked, the paper sheets do not block the opening portions of the partition plate 350, allowing heat to diffuse and rise to the side of the extension lifter via the opening portions 501 of the partition plate 350, and warm the region of the extension lifter 61*b* where the paper sheets are stacked.

Each opening portion 501 of the partition plate 350 is formed to have the size through which at least the first of an adult male can pass, allowing the user to remove a foreign substance that exists in the space below the extension lifter 61*b* by inserting his/her hand from the opening portion. Moreover, the partition plate 350 has a function of preventing collapse of regular-size paper sheets. Furthermore, the partition plate 350 has a function of supporting the extension lifter 61*b* in a state in which the extension lifter 61*b* is not coupled with the main lifter 61*a*.

As described above, according to this embodiment, by providing the partition plate 350 with the opening portions 501 each having the size through which at least the first of an adult male can pass, it is possible to supply heat of a cassette heater efficiently regardless of whether regular-size paper sheets or elongated-size paper sheets are stacked. In addition, the user can remove the foreign substance that exists in the space below the extension lifter 61*b*.

In the above-described embodiment, the image forming system is formed by attaching the sheet feeding apparatus 30 to the image forming apparatus 900 as a discrete unit. However, the present invention is also applicable to a mode in which the image forming apparatus is formed by attaching the sheet feeding apparatus 30 to the image forming apparatus 900 integrally.

In the above-described embodiment, the arrangement using the cassette heater 351 has been described. That is, in the above-described embodiment, the cassette heater 351 is arranged for the purpose of generating an air flow in order to keep air permeability satisfactorily between the space in the lower portion of the main lifter 61*a* and the space in the lower portion of the extension lifter 61*b*. However, another arrangement may be provided in order to generate an air flow. For example, an arrangement that arranges a fan on an apparatus wall surface in the lower portion of the main lifter 61*a* to generate an air flow inside may be adopted. Alternatively, an arrangement that generates an air flow between the space in the lower portion of the main lifter 61*a* and the space in the lower portion of the extension lifter 61*b* by combining the cassette heater 351 and the fan may be adopted.

<Other Embodiments>

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-167641, filed Aug. 31, 2017, and No. 2018-150627, filed Aug. 9, 2018, which are hereby incorporated by reference herein in their entirety.

What is claimed is:

1. A stacking apparatus capable of stacking, as sheets fed to a predetermined apparatus, a first sheet and a second sheet having a larger size than the first sheet with respect to a feeding direction in which the sheets are fed to the predetermined apparatus, the stacking apparatus comprising:

a first stacking unit configured to be vertically movable and stack the first sheet;

a second stacking unit configured to stack the second sheet in cooperation with the first stacking unit at a height which is equal to or higher than a predetermined height, wherein the second stacking unit is configured to be vertically movable, and the predetermined height is a lower-limit of a range in which the second stacking unit can vertically move;

a limiting unit configured to move along the feeding direction and limit a trailing edge of a stacked sheet in the feeding direction; and a partition member configured to partition a space, which has a height lower than the predetermined height, into a first space corresponding to the first stacking unit and a second space corresponding to the second stacking unit with respect to the feeding direction, wherein the partition member includes a first opening portion for allowing communication between the first space and the second space, and a second opening portion for allowing the limiting unit to move, and wherein an upper-edge position of the first opening portion is lower than the predetermined height and higher than a lower-limit position, and the lower-limit position is a lower-limit of a range in which the first stacking unit can vertically move.

2. The apparatus according to claim 1, wherein the partition member supports the second stacking unit at the predetermined height in a case in which the first stacking unit is lower than the predetermined height.

3. The apparatus according to claim 1, further comprising a heating unit arranged in a lower portion of the first stacking unit and configured to generate heat.

4. The apparatus according to claim 3, wherein the heating unit is arranged in the lower portion of the first stacking unit so as not to straddle a lower portion of the second stacking unit.

5. The apparatus according to claim 1, wherein in a state in which the first stacking unit is located at the predetermined height, the second stacking unit is coupled with the first stacking unit and capable of stacking the second sheet in cooperation with the first stacking unit.

6. The apparatus according to claim 1, wherein when the first stacking unit is located at the height which is equal to or higher than the predetermined height, an opening area of the first opening portion is maximized.

7. The apparatus according to claim 1, wherein when the first stacking unit stacks the first sheet and is located at the height lower than the predetermined height, at least a part of the opening area of the first opening portion is covered with stacked first sheets.

8. The apparatus according to claim 1, wherein when the first stacking unit is located at the height which is equal to or higher than the predetermined height, the second stacking unit moves vertically in synchronism with the first stacking unit.

9. A feeding apparatus comprising:

a stacking apparatus capable of stacking, as sheets fed to a predetermined apparatus, a first sheet and a second sheet having a larger size than the first sheet with respect to a feeding direction in which the sheets are fed to the predetermined apparatus; and a feeding unit configured to feed a sheet stacked on the stacking apparatus, wherein the stacking apparatus includes:

a first stacking unit configured to be vertically movable and stack the first sheet;

a second stacking unit configured to stack the second sheet in cooperation with the first stacking unit at a height which is equal to or higher than a predetermined height, wherein the second stacking unit is configured to be vertically movable, and the predetermined height is a lower-limit of a range in which the second stacking unit can vertically move;

a limiting unit configured to move along the feeding direction and limit a trailing edge of a stacked sheet in the feeding direction; and a partition member configured to partition a space, which has a height lower than the predetermined height, into a first space corresponding to the first stacking unit and a second space corresponding to the second stacking unit with respect to the feeding direction, wherein the partition member includes a first opening portion for allowing communication between the first space and the second space, and a second opening portion for allowing the limiting unit to move, and wherein an upper-edge position of the first opening portion is lower than the predetermined height and is higher than a lower-limit position, and the lower-limit position is a lower-limit of a range in which the first stacking unit can vertically move.

10. An image forming apparatus comprising:

a stacking apparatus capable of stacking, as sheets fed to a predetermined apparatus, a first sheet and a second sheet having a larger size than the first sheet with respect to a feeding direction in which the sheets are fed to the predetermined apparatus;

a feeding unit configured to feed the sheets stacked on the stacking apparatus; and an image forming unit configured to form an image on the sheets fed by the feeding unit, wherein the stacking apparatus includes:

a first stacking unit configured to be vertically movable and stack the first sheet;

a second stacking unit configured to stack the second sheet in cooperation with the first stacking unit at a height which is equal to or higher than a predetermined height, wherein the second stacking unit is configured to be vertically movable, and the predetermined height is a lower-limit of a range in which the second stacking unit can vertically move;

a limiting unit configured to move along the feeding direction and limit a trailing edge of a stacked sheet in the feeding direction; and a partition member configured to partition a space, which has a height lower than the predetermined height, into a first space corresponding to the first stacking unit and a second space corresponding to the second stacking unit with respect to the feeding direction, wherein the partition member includes a first opening portion for allowing communication between the first space and the second space, and a second opening portion for allowing the limiting unit to move, and wherein an upper-edge position of the first opening portion is lower than the predetermined height and is higher than a lower-limit position, and the lower-limit position is a lower-limit of a range in which the first stacking unit can vertically move.

* * * * *